US010357137B2

(12) United States Patent
Holz

(10) Patent No.: US 10,357,137 B2
(45) Date of Patent: Jul. 23, 2019

(54) CLEANING DEVICE FOR AN AUTONOMOUS FLOOR TREATMENT APPLIANCE

(71) Applicant: Miele & Cie. KG, Guetersloh (DE)

(72) Inventor: Dominik Holz, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 476 days.

(21) Appl. No.: 15/170,995

(22) Filed: Jun. 2, 2016

(65) Prior Publication Data

US 2016/0353955 A1 Dec. 8, 2016

(30) Foreign Application Priority Data

Jun. 3, 2015 (DE) ..... 10 2015 108 823

(51) Int. Cl.

| | |
|---|---|
| ***A47L 11/24*** | (2006.01) |
| ***A47L 9/00*** | (2006.01) |
| ***A47L 11/40*** | (2006.01) |
| ***B08B 1/00*** | (2006.01) |

(52) U.S. Cl.

CPC ..... *A47L 11/24* (2013.01); *A47L 9/00* (2013.01); *A47L 11/4036* (2013.01); *A47L 11/4052* (2013.01); *B08B 1/002* (2013.01); *A47L 2201/00* (2013.01); *A47L 2201/06* (2013.01)

(58) Field of Classification Search

None

See application file for complete search history.

(56) References Cited

U.S. PATENT DOCUMENTS

| | | | |
|---|---|---|---|
| 2008/0276407 | A1 | 11/2008 | Schnittman et al. |
| 2013/0086760 | A1 | 4/2013 | Han |

FOREIGN PATENT DOCUMENTS

| | | | |
|---|---|---|---|
| GB | 2432301 | A | 5/2007 |
| JP | 2013233305 | A | 11/2013 |

OTHER PUBLICATIONS

Machine Translation of JP2013-233305 by Kobayashi et al., published Nov. 21, 2013.*

* cited by examiner

*Primary Examiner* — Mikhail Kornakov
*Assistant Examiner* — Ryan Coleman
(74) *Attorney, Agent, or Firm* — Leydig, Voit & Mayer, Ltd.

(57) ABSTRACT

A cleaning device for an autonomous floor treatment appliance, the cleaning device being suitable for cleaning wall portions that are close to a floor and border a floor surface to be cleaned, includes a fixing element to connect the cleaning device to a housing portion of the autonomous floor treatment appliance and a cleaning element carrier having a cleaning element, the cleaning element carrier being connected to the fixing element.

13 Claims, 5 Drawing Sheets

CLEANING DEVICE FOR AN AUTONOMOUS FLOOR TREATMENT APPLIANCE

CROSS-REFERENCE TO PRIOR APPLICATION

Priority is claimed to German Patent Application No. DE 10 2015 108 823.1, filed on Jun. 3, 2015, the entire disclosure of which is hereby incorporated by reference herein.

FIELD

The present invention relates to a cleaning device for an autonomous floor treatment appliance, the cleaning device being suitable for cleaning wall portions that are close to the floor and border a floor surface to be cleaned.

BACKGROUND

Autonomous floor treatment appliances, in particular vacuum cleaning and mopping robots, are used for autonomous cleaning and care of floor surfaces. The commercially available autonomous floor treatment appliances achieve cleaning performance levels which substantially eliminate the need for manual secondary cleaning of the floor surface. However, the problem here is that the cleaning action of the known autonomous floor treatment appliances has heretofore been limited to those regions of a floor surface which are traversable by the autonomous floor treatment appliance. Wall portions that are close to the floor and bound a floor surface to be cleaned, such as wall bases or baseboards, are not cleaned, or cleaned only to a very limited extent, by autonomous floor treatment appliances. However, since dust and dirt particles accumulate especially on such wall portions close to the floor, these wall portions continuously require manual secondary cleaning. This contradicts the concept of autonomous floor cleaning by autonomous floor treatment appliances.

The prior art describes autonomous floor treatment appliances having side brushes. These side brushes enable autonomous floor treatment appliances to remove dust and dirt particles also from edge regions of a floor surface to be cleaned. However, since these side brushes are oriented toward the floor surface to be cleaned, they are not suitable for cleaning wall portions close to the floor, such as wall bases or baseboards. In particular, if the wall portions close to the floor form an exposed front face, they are not reached or cleaned by the side brushes.

SUMMARY

In an embodiment, the present invention provides a cleaning device for an autonomous floor treatment appliance, the cleaning device being suitable for cleaning wall portions that are close to a floor and border a floor surface to be cleaned. The cleaning device includes a fixing element to connect the cleaning device to a housing portion of the autonomous floor treatment appliance and a cleaning element carrier having a cleaning element, the cleaning element carrier being connected to the fixing element.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
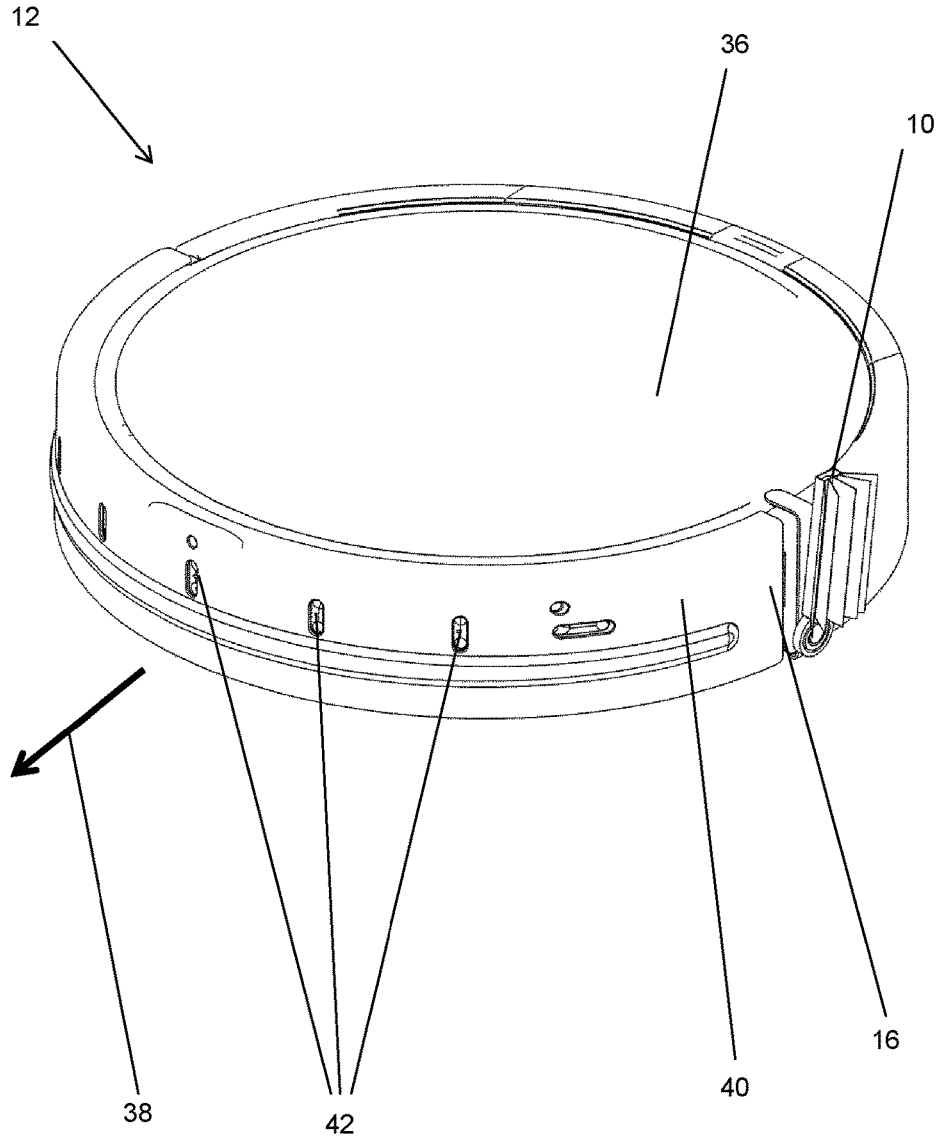
FIG. 1 is a perspective view of an autonomous floor treatment appliance having a cleaning device.

It is preferred that the cleaning device have a fixing element allowing the cleaning device to be connected to a housing portion of an autonomous floor treatment appliance, a cleaning element carrier having a cleaning element being disposed on the cleaning device. The cleaning device is detachably connectable to a housing portion of an autonomous floor treatment appliance. In a preferred embodiment, the fixing element is latchable to the housing of the autonomous floor treatment appliance. The fixing element is configured with an upper and a lower retaining device, the retaining devices allowing the fixing element to be latched to a housing portion of the autonomous floor treatment appliance. In an alternative embodiment, the fixing element is connected to the housing of the autonomous floor treatment appliance via an adhesive element.

The attachment of the cleaning device to a housing portion of an autonomous floor treatment appliance enables autonomous cleaning of wall portions close to the floor, such as wall bases or baseboards. This enables the autonomous floor treatment appliance to autonomously remove dirt from wall portions close to the floor by means of the cleaning elements of the cleaning device. Moreover, the detachable attachment of the cleaning device via the fixing element allows existing autonomous floor treatment appliances to be retrofitted with such cleaning devices.

It is preferred that the cleaning device have a pivoting element movably, especially pivotally, connected to the fixing element. The cleaning element carrier is attached to the pivoting element of the cleaning device. Thus, the pivoting element allows the cleaning element carrier to be movably, especially pivotally, supported relative to the fixing element. In other words, the pivoting element, and thus also the cleaning element carrier, can be pivoted relative to the fixing element. Since the fixing element can be connected to a housing portion of an autonomous floor treatment appliance, the pivoting element accordingly allows pivoting movement of the cleaning element carrier relative a housing portion of an autonomous floor treatment appliance.

Since the cleaning device is attached externally to a housing portion of the autonomous floor treatment appliance, the cleaning device extends the external geometry of the autonomous floor treatment appliance. This in principle increases the risk of the autonomous floor treatment appliance getting stuck on obstacles on the surface to be cleaned. The risk of the autonomous floor treatment appliance getting stuck is increased in particular because the cleaning device extends also upwardly beyond the autonomous floor treatment appliance. Consequently, the cleaning device could get jammed on obstacles as the autonomous floor treatment appliance passes underneath. The movability of the pivoting element and the cleaning element carrier in relation to the fixing element and the housing portion of the autonomous floor treatment appliance substantially prevents the cleaning device from getting jammed or caught during autonomous cleaning travel of the autonomous floor treatment appliance. In other words, the movability of the pivoting element and the cleaning element carrier allows the same to avoid possible obstacles, and thus to prevent the autonomous floor treatment appliance from getting stuck.

It is also preferred that the cleaning element carrier be detachably connectable to the pivoting element. In a preferred embodiment, the cleaning element carrier provided with a cleaning element is connectable to the pivoting element by means of a push-fit connection. The detachable attachment of the cleaning element carrier to the pivoting element permits quick and easy replacement of the cleaning element carrier. This allows the user to regularly replace or clean the cleaning element carrier without much effort and without removing the entire cleaning device from the autonomous floor treatment appliance. Thus, the cleaning elements on the cleaning element carrier can be cleaned or replaced by the user. Moreover, the cleaning device can be provided with cleaning element carriers having different cleaning elements in order to make available cleaning elements that are optimally suited for the different scenarios associated with the cleaning of wall portions close to the floor.

In a preferred embodiment, the pivoting element has a spring element, in particular a spiral spring, the spring element exerting a spring force on the pivoting element, the spring force counteracting pivoting movement of the pivoting element. The spring element exerts a spring force on the pivoting element toward a first position in which the pivoting element assumes a substantially upright position. In the first position, the pivoting element is oriented approximately vertically to the floor surface to be cleaned when the cleaning device is attached to the autonomous floor treatment appliance. The spring force is selected such that it can be overcome by the driving force of the autonomous floor treatment appliance. This ensures that, in the event that the pivoting element gets caught on an obstacle on the floor surface to be cleaned, the pivoting element can pivot against the spring force of the spring element to an approximately horizontal second position. This prevents the autonomous floor treatment appliance from getting stuck. Once the autonomous floor treatment appliance has passed the obstacle, the spring force of the spring element causes the pivoting element to pivot from the second position back to the first, approximately upright position.

It is preferred that the cleaning element carrier have textile elements as the cleaning element. The textile elements are arranged in a fan-like or comb-like manner on the cleaning element carrier. In a preferred embodiment, the textile elements used are, in particular, microfiber textiles. Due to their inherent material properties, microfiber textiles are particularly suitable for picking up and binding dust and dirt particles. This ensures a particularly thorough cleaning of wall portions close to the floor.

In addition, it is preferred that the cleaning element carrier have brush elements as the cleaning element. In this case, at least two bristle clusters are attached to the cleaning element carrier, each of the bristle clusters having a plurality of bristle filaments. Brush elements are, in particular, suitable for removing dust and dirt particles from wall portions close to the floor. In addition, brush elements are capable of adequately handling even scenarios of coarser dirt.

In an autonomous floor treatment appliance having a cleaning device according to one of the embodiments described above, the cleaning device is substantially attached to a housing portion of the autonomous floor treatment appliance that is oriented substantially vertically to a floor surface to be cleaned. In other words, the cleaning device is disposed substantially laterally adjacent to a housing portion of the autonomous floor treatment appliance. Thus, the cleaning device is oriented substantially toward a wall portion that is close to the floor and approximately vertical to a floor surface to be cleaned.

The lateral attachment of the cleaning device to a housing portion of the autonomous floor treatment appliance extends its range of action to wall portions close to the floor. This now also allows cleaning of regions which are located above the floor areas that are traversable by the floor treatment appliance.

Moreover, it is preferred that an angle be defined between the pivoting element and a straight line approximately vertical to the floor surface to be cleaned. In a preferred embodiment, the angle has a magnitude of between 10 and 90 degrees and, in a particularly preferred embodiment, a magnitude of between 25 and 80 degrees. In other words, in relation to the approximately vertical orientation of the lateral housing portion of the autonomous floor treatment appliance, the pivoting element is tilted toward the wall portions close to the floor that are to be cleaned. This means that, unlike the fixing element, the pivoting element is not arranged approximately vertically on the side wall of the autonomous floor treatment appliance, but tilted by an angle toward the wall portions close to the floor that are to be cleaned. However, in an alternative embodiment, it is also conceivable that the pivoting element could be arranged on the lateral housing portion of the autonomous floor treatment appliance in such a way that it does not form an angle therewith; i.e., substantially vertically.

The angle between the straight line and the pivoting element leads to an improvement in the cleaning performance of the cleaning device. In particular, if wall portions close to the floor form horizontal surfaces on which dust and dirt particles settle, the tilt of the pivoting element enlarges the dynamic contact area of the cleaning element. In other words, the angle enlarges the area of the cleaning element that is in contact with the wall portion close to the floor that is to be cleaned. This significantly improves the cleaning performance of the cleaning device.

It is also preferred that the cleaning element carrier of the cleaning device extend upwardly beyond the housing of the autonomous floor treatment appliance. To this end, both the pivoting element and the cleaning element carrier are designed such that when the cleaning device is attached to the housing of the autonomous floor treatment appliance, the cleaning element carrier extends the height of the autonomous floor treatment appliance. However, in an alternative embodiment, it is also conceivable to provide a cleaning device whose cleaning element carrier does not extend upwardly beyond the housing of the autonomous floor treatment appliance. This is especially advantageous when the autonomous floor treatment appliance itself exceeds a height of 10 centimeters.

The known autonomous floor treatment appliances have an overall height of from about eight to ten centimeters. This ensures, on the one hand, that sufficient space is available inside the housing for the necessary components of the autonomous floor treatment appliance. On the other hand, this enables the autonomous floor treatment appliance to pass underneath obstacles, such as furniture, and thus to also clean the floor surface under obstacles. However, since some wall portions close to the floor, such as wall bases or baseboards, are higher than ten centimeters, there is a need for cleaning element carriers that extend upwardly beyond the housing of an autonomous floor treatment appliance. This makes it possible to also clean wall portions close to the floor which are higher than the housing of an autonomous floor treatment appliance.

Furthermore, it is preferred that the cleaning device be attached to a housing portion of the autonomous floor treatment appliance that is oriented substantially perpendicularly to a main direction of travel of the autonomous floor treatment appliance. The cleaning device is arranged on a housing portion of the autonomous floor treatment appliance in such a way that the cleaning device is oriented toward wall portions close to the floor that extend substantially parallel to the main direction of travel of the autonomous floor treatment appliance. The enables an autonomous floor treatment appliance to clean wall portions close to the floor based on existing travel strategies thereof, such as wall-following.

A method for controlling an autonomous floor treatment appliance having a cleaning device according to one of the embodiments described above includes the following steps:

detecting edge regions of a surface to be cleaned; and traveling along the edge regions of a surface to be cleaned, with the cleaning element of the cleaning device being in contact with the wall portions close to the floor, in particular wall bases or baseboards, of the surface to be cleaned; and traveling again along the edge regions of a surface to be cleaned.

Such a method ensures that all wall portions close to the floor of a surface to be cleaned are freed of dust and dirt particles. The method step of traveling again along the edge regions ensures that the dust and dirt particles that were moved from the wall portions close to the floor onto the surface to be cleaned during the initial travel along the edge regions are picked up as well. Edge regions of a surface to be cleaned are those regions of a surface which are located in the immediate vicinity of an outer boundary of the floor surface, in particular a wall.

FIG. 1 shows in perspective view an autonomous floor treatment appliance 12 having a cleaning device 10. Autonomous floor treatment appliance 12 has a housing 36, with which it travels over the floor surface to be cleaned. Housing 36 has a substantially circular basic shape and has a nearly closed circumferential side wall 40. Sensors 42 for navigation and obstacle detection are disposed in the forward portion of side wall 40 with respect to main direction of travel 38 of autonomous floor treatment appliance 12. Cleaning device 10 is attached to a housing portion 16 of side wall 40 that is substantially perpendicular to main direction of travel 38 of autonomous floor treatment appliance 12. Moreover, cleaning device 10 is disposed substantially laterally adjacent to side wall 40 of autonomous floor treatment appliance 12.

Figure 2:
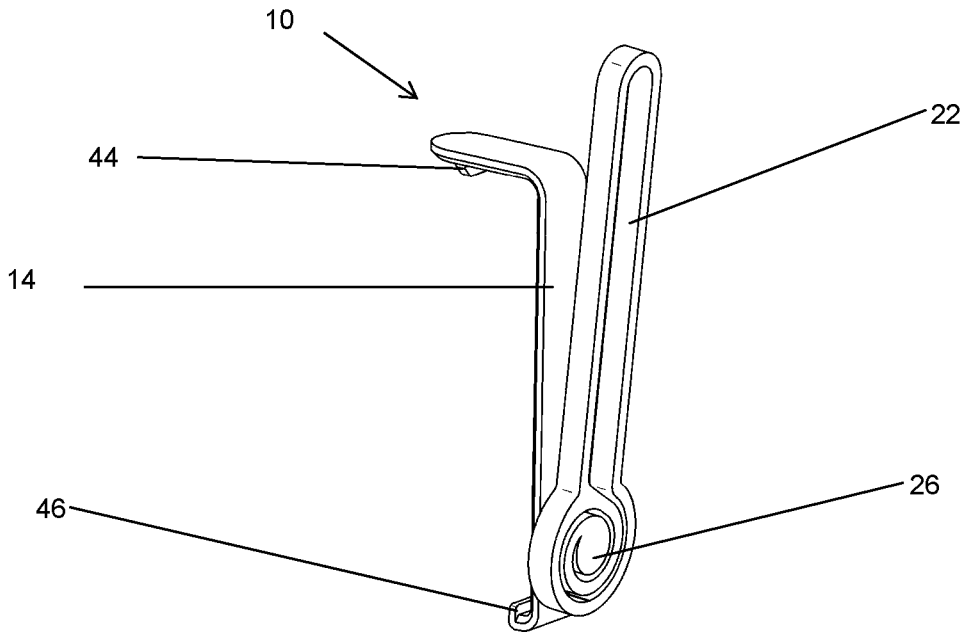
FIG. 2 is a perspective view of a cleaning device, shown without a cleaning element carrier.

FIG. 2 shows in perspective view a cleaning device 10 having a fixing element 14 and a pivoting element 22. Fixing element 14 has a clamp-like shape including an upper retaining device 44 and a lower retaining device 46. Due to its clamp-like shape, fixing element 14 is suitable to embrace side wall 40 of autonomous floor treatment appliance 12, and to bring into engagement the upper retaining device 44 on the upper side of autonomous floor treatment appliance 12 and the lower retaining device 46 on the underside thereof. Upper and lower retaining devices 44, 46 together provide reliable fixing of cleaning device 10 to housing 36 of autonomous floor treatment appliance 12.

Pivoting element 22 is movably attached to fixing element 14 approximately at the height of lower retaining device 46 of fixing element 14. Pivoting element 22 is pivotally connected to fixing element 14 by a pivot pin 48. Further, pivoting element 22 extends from pivot pin 48 approximately parallel to fixing element 14 and upwardly therebeyond. In the region of pivot pin 48, a spiral spring 26 is disposed in pivoting element 22. Spiral spring 26 exerts a spring force on pivoting element 22. The spring force acts on pivoting element 22 in the form of a torque at pivot pin 48 between fixing element 14 and pivoting element 22. The spring force holds pivoting element 22 in a position in which it is oriented approximately parallel to fixing element 14.

Figure 3:
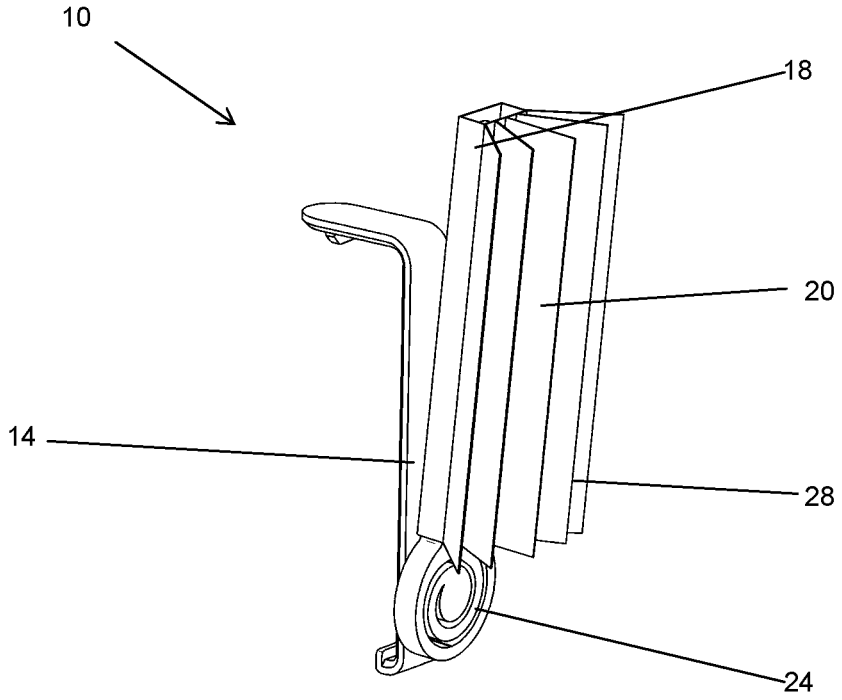
FIG. 3 is a perspective view of a cleaning device having a cleaning element carrier with a textile element.

FIG. 3 shows in perspective view a cleaning device 10 with a cleaning element carrier 18 attached. Cleaning element carrier 18 is detachably connected to pivoting element 22 by means of a push-fit connection and is provided with textile elements 28 as cleaning elements 20. Textile elements 28 extend over the entire height of cleaning element carrier 18 and have a fan-like configuration.

Figure 4:
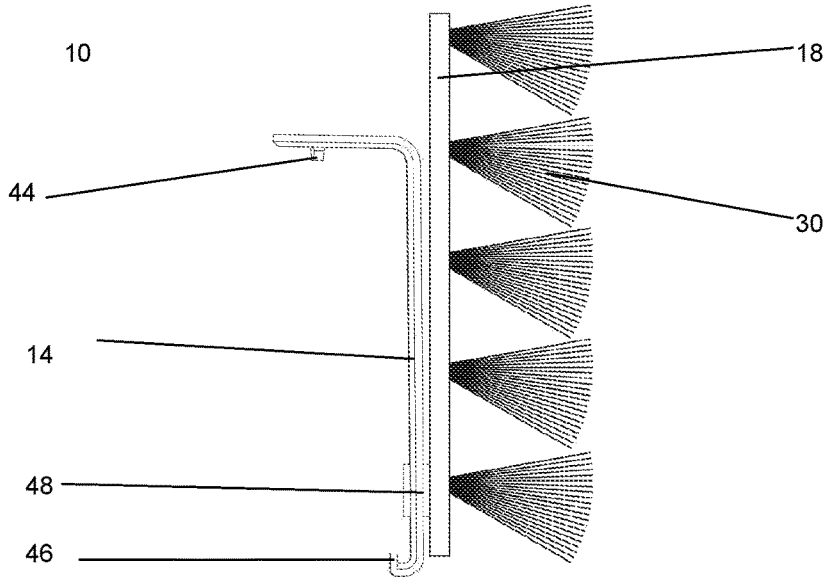
FIG. 4 is a side view of a cleaning device having a cleaning element carrier with brush elements.

FIG. 4 shows in side view a cleaning device 10 having a cleaning element carrier 18. Cleaning element carrier 18 is provided with five brush elements 30 as cleaning elements 20. Each of brush elements 30 includes a plurality of bristle filaments. Brush elements 30 are disposed on cleaning element carrier 18 in such a way that they form a substantially continuous active surface at the free ends thereof.

Figure 5:
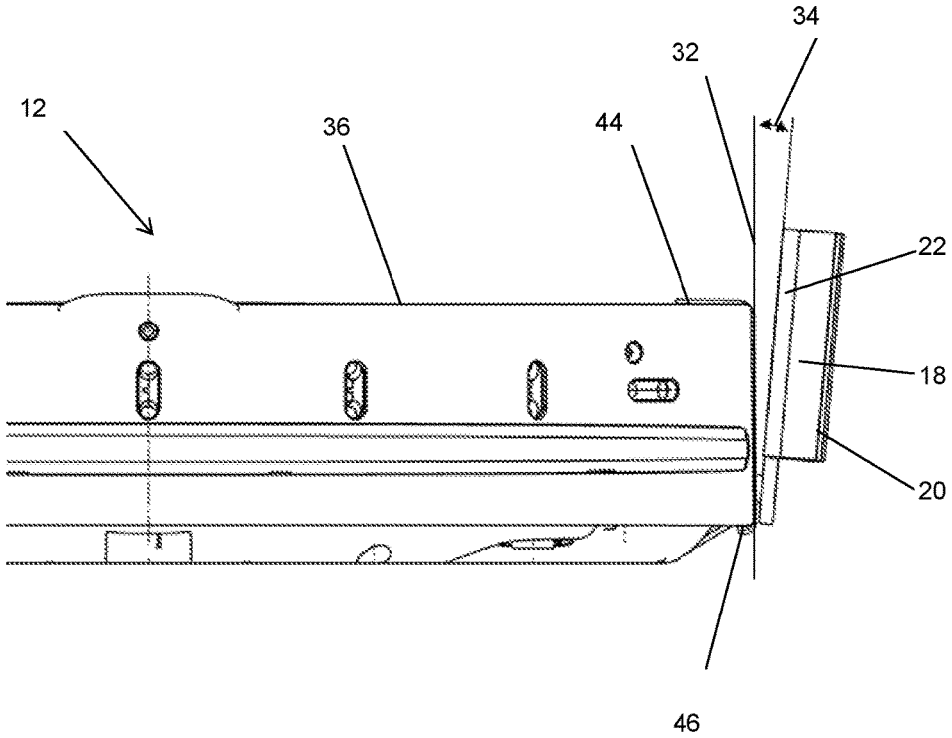
FIG. 5 is a front view of an autonomous floor treatment appliance having a cleaning device.

FIG. 5 shows in front view an autonomous floor treatment appliance 12 having a cleaning device 10. Cleaning device 10 is attached via fixing element 14 to the side of housing 36 of autonomous floor treatment appliance 12. Upper retaining device 44 of fixing element 14 is in engagement with the upper side of housing 36 of autonomous floor treatment appliance 12. Lower retaining device 46 of fixing element 14 is in engagement with the underside of housing 36 of autonomous floor treatment appliance 12. Pivoting element 22 of cleaning device 10 is disposed on the side of fixing element 14 that faces away from autonomous floor treatment appliance 12. A cleaning element carrier 18 having a cleaning element 20 is attached to pivoting element 22. Cleaning element carrier 18 extends upwardly beyond housing 36 of autonomous floor treatment appliance 12.

A straight line 32 extending parallel to side wall 40 of autonomous floor treatment appliance 12 is oriented approximately vertically to the floor surface to be cleaned. An angle 34 is defined between this straight line 32 and the side of pivoting element 22, respectively of cleaning element carrier 18, that faces autonomous floor treatment appliance 12. This angle 34 has a magnitude of approximately 25 degrees. Consequently, pivoting element 22 and cleaning element carrier 18 are tilted by this angle 34 away from straight line 32 toward the horizontal.

Figure 6:
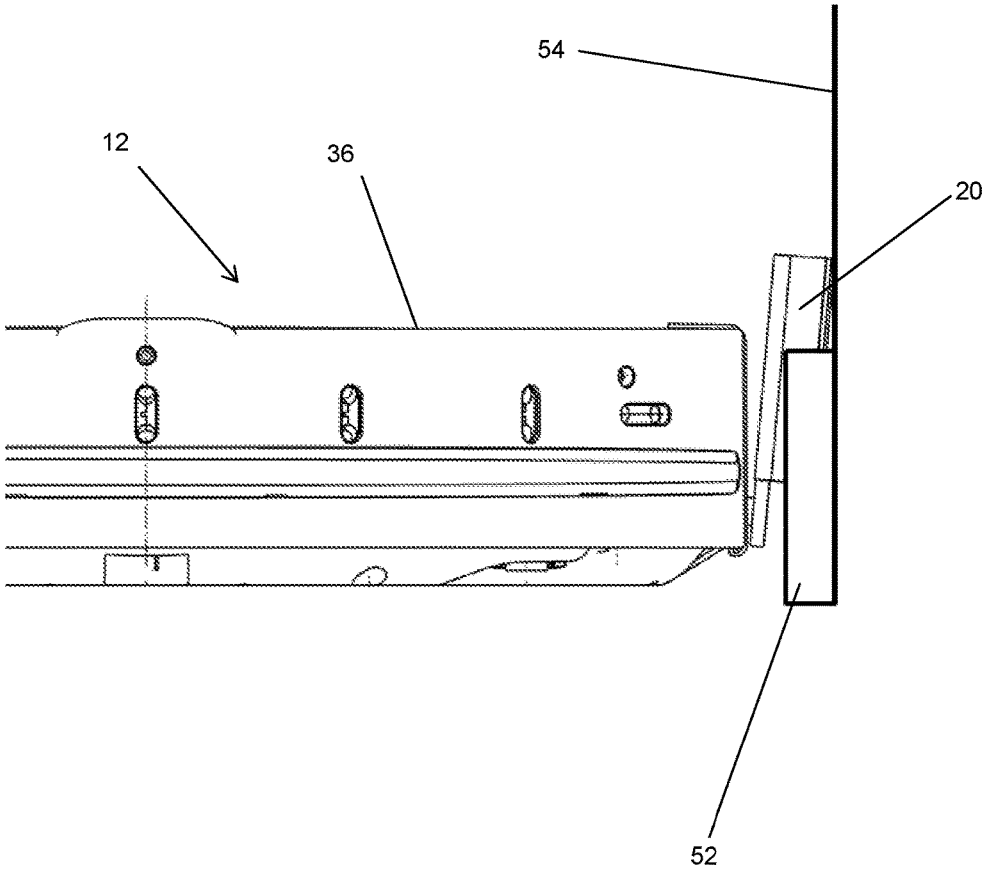
FIG. 6 is a front view of an autonomous floor treatment appliance having a cleaning device.

FIG. 6 shows in front view an autonomous floor treatment appliance 12 having a cleaning device 10. A cleaning device 10 is attached to the side of housing 36 of autonomous floor treatment appliance 12. Cleaning element 20 of cleaning device 10 is in contact with a wall portion 52 close to the floor, which forms part of a wall 54 bounding a floor surface to be cleaned. The wall portion 52 close to the floor forms two surfaces. The first surface of the wall portion 52 close to the floor is approximately vertical to the surface to be cleaned and extends approximately parallel to wall 54. The second surface of the wall portion 52 close to the floor extends approximately parallel to the surface to be cleaned and is approximately horizontal to wall 54. The second surface of the wall portion 52 close to the floor constitutes a surface on which dust and dirt particles can settle. Cleaning element 20 of cleaning device 10 is in contact with the first and second surfaces of the wall portion 52 close to the floor. Because cleaning element carrier 18, respectively pivoting element 22, is tilted by an angle 34 away from straight line 32, cleaning device 10 is in particular suitable for cleaning the second surface of the wall portion 52 close to the floor of dust and dirt particles.

Figure 7:
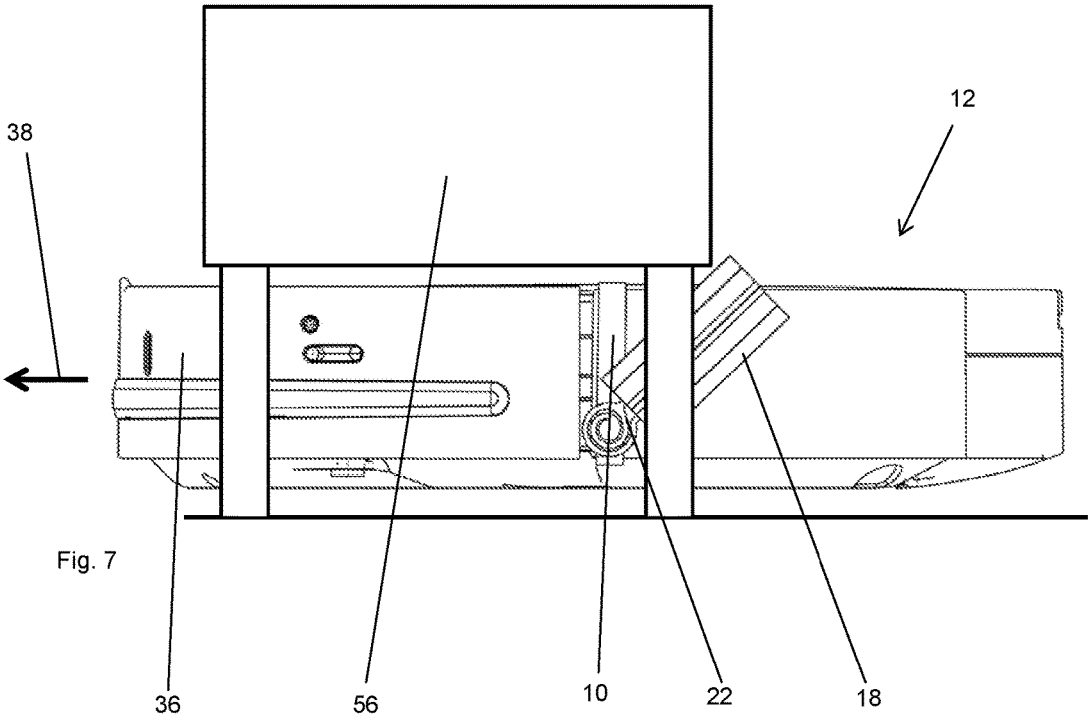
FIG. 7 is a side view of an autonomous floor treatment appliance having a cleaning device.

FIG. 7 shows in side view an autonomous floor treatment appliance 12 having a cleaning device 10. An obstacle 56 having a hollow space at its underside is located on the surface to be cleaned. The hollow space has a height that would allow passage of an autonomous floor treatment appliance 12 without a cleaning device 10 attached thereto. This means that, in an operating condition without the cleaning device attached, housing 36 of the autonomous floor treatment appliance is able to pass underneath the obstacle. Autonomous floor treatment appliance 12, with cleaning device 10 attached thereto, is located under obstacle 56 and passes underneath the same in main direction of travel 38. During this, cleaning element carrier 18 is in contact with obstacle 56, obstacle 56 exerting a force on cleaning element carrier 18 and pivoting element 22, causing the two components to pivot from an upright position to an inclined position. The tilting of the two components reduces the height of autonomous floor treatment appliance 12 with the attached cleaning device 10, thereby enabling autonomous floor treatment appliance 12 to pass underneath obstacle 56.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 cleaning device
12 autonomous floor treatment appliance
14 fixing element
16 housing portion
18 cleaning element carrier
20 cleaning element
22 pivoting element
24 spring element
26 spiral spring
28 textile elements
30 brush elements
32 straight line
34 angle
36 housing
38 main direction of travel
40 side wall
42 sensors
44 upper retaining device
46 lower retaining device
48 pivot pin
52 wall portion close to the floor
54 wall
56 obstacle

The invention claimed is:

1. A cleaning device for an autonomous floor treatment appliance, the cleaning device being suitable for cleaning wall portions that border a floor surface to be cleaned, the cleaning device comprising:

a fixing element configured to connect the cleaning device to a housing portion of the autonomous floor treatment appliance;

a cleaning element carrier having a cleaning element, the cleaning element carrier being connected to the fixing element, and the cleaning element being configured to clean wall portions above the floor surface when the fixing element connects the cleaning device to the housing portion and the autonomous floor treatment appliance moves along the floor surface to treat the floor surface; and a pivoting element pivotably connected to the fixing element, the pivoting element being pivotable about a pivot axis that is oriented substantially parallel to the floor surface when the fixing element connects the cleaning device to the housing portion and the autonomous floor treatment appliance moves along the floor surface to treat the floor surface.

2. The cleaning device of claim 1, wherein the cleaning element carrier is detachably connectable to the pivoting element.

3. The cleaning device of claim 1, wherein the pivoting element has a spring element configured to exert a spring force on the pivoting element, the spring force counteracting pivoting movement of the pivoting element.

4. The cleaning device of claim 1, wherein the cleaning element comprises textile elements.

5. The cleaning device of claim 1, wherein the cleaning element comprises brush elements.

6. The cleaning device as recited in claim 3, wherein the spring element comprises a spiral spring.

7. An autonomous floor treatment appliance having the cleaning device according to claim 1, wherein the cleaning device is substantially attached to the housing portion of the autonomous floor treatment appliance, and the housing portion is oriented substantially vertically to the floor surface to be cleaned.

8. An autonomous floor treatment appliance having the cleaning device according to claim 1, wherein an angle is defined between the pivoting element and a straight line approximately vertical to the floor surface to be cleaned, the angle having a magnitude of between 10 and 90 degrees.

9. The autonomous floor treatment appliance of claim 8, wherein the angle has a magnitude of between 25 and 80 degrees.

10. An autonomous floor treatment appliance having a cleaning device according to claim 1, wherein the cleaning element carrier of the cleaning device extends upwardly beyond a housing of the autonomous floor treatment appliance.

11. An autonomous floor treatment appliance having the cleaning device according to claim 1, wherein the cleaning device is attached to a housing portion of the autonomous floor treatment appliance that is oriented substantially perpendicularly to a main direction of travel of the autonomous floor treatment appliance.

12. A method for controlling an autonomous floor treatment appliance having the cleaning device according to claim 1, the method comprising:

detecting edge regions of the floor surface to be cleaned;

traveling along the edge regions of the floor surface to be cleaned, with the cleaning element of the cleaning device being in contact with wall portions above the floor surface to be cleaned; and traveling again along the edge regions of the floor surface to be cleaned.

13. The method for controlling an autonomous floor treatment appliance of claim 12, wherein the wall portions close to the floor comprise wall bases or baseboards.

* * * * *